US011674671B2

(12) United States Patent
Van Eeuwijk et al.

(10) Patent No.: US 11,674,671 B2
(45) Date of Patent: Jun. 13, 2023

(54) LIGHTING DEVICE ARRANGED TO BE ATTACHED TO A MOUNTING SURFACE OF AN OBJECT

(71) Applicant: SIGNIFY HOLDING B.V., Eindhoven (NL)

(72) Inventors: Alexander Henricus Waltherus Van Eeuwijk, Eindhoven (NL); Robert Jacob Pet, Waalre (NL); Ties Van Bommel, Horst (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/908,891

(22) PCT Filed: Mar. 1, 2021

(86) PCT No.: PCT/EP2021/055009
§ 371 (c)(1),
(2) Date: Sep. 1, 2022

(87) PCT Pub. No.: WO2021/175765
PCT Pub. Date: Sep. 11, 2021

(65) Prior Publication Data

US 2023/0089209 A1 Mar. 23, 2023

(30) Foreign Application Priority Data

Mar. 6, 2020 (EP) ..... 20161351

(51) Int. Cl.
*F21V 21/08* (2006.01)
*F21S 4/24* (2016.01)
(Continued)

(52) U.S. Cl.
CPC ..... *F21V 21/0808* (2013.01); *F21S 4/24* (2016.01); *F21V 33/006* (2013.01); *F21Y 2103/10* (2016.08); *F21Y 2115/10* (2016.08)

(58) Field of Classification Search
CPC ..... F21V 21/0808; F21V 33/006; F21V 33/0012; F21V 33/0024; F21Y 2103/10; F21Y 2115/10; F21S 4/24
See application file for complete search history.

(56) References Cited

U.S. PATENT DOCUMENTS 4,761,720 A 8/1988 Solow
9,085,903 B2 * 7/2015 Schlueter ..... F21V 3/00
(Continued)

FOREIGN PATENT DOCUMENTS

DE 202012011551 U1 4/2013
DE 202015105161 U1 9/2016
EP 3494837 A1 6/2019

*Primary Examiner* — Peggy A Neils

(57) ABSTRACT

A lighting device (1000), which is arranged to be attached to a mounting surface of an object, comprises an LED strip (100). The LED strip (100) comprises (i) an elongated carrier (1100) with an upper surface (1110) having a first upper surface portion (1111), (ii) a plurality of light-emitting diodes (1200) arranged on the first upper surface portion (1111), and (iii) an attachment component (1300) for attaching the lighting device (1000) to the mounting surface. The attachment component (1300) comprises an adhesive surface (1301) that faces in at least one of a first direction (1121) and a second direction (1122), the first direction (1121) being parallel to the normal of the upper surface (1110), and the second direction (1122) being perpendicular to the normal of the upper surface (1110) and to the direction of elongation (1120) of the elongated carrier (1100).

8 Claims, 8 Drawing Sheets

(51) Int. Cl.

| | |
|---|---|
| ***F21V 33/00*** | (2006.01) |
| ***F21Y 103/10*** | (2016.01) |
| ***F21Y 115/10*** | (2016.01) |

(56) References Cited

U.S. PATENT DOCUMENTS

| | | | | |
|---|---|---|---|---|
| 9,679,503 | B2 * | 6/2017 | Weyer | G09F 3/204 |
| 9,897,292 | B1 | 2/2018 | Lindblad et al. | |
| 10,702,078 | B1 * | 7/2020 | Walker | A47F 5/0025 |
| 2003/0137828 | A1 * | 7/2003 | Ter-Hovhannisian | F21S 4/20 362/249.02 |
| 2006/0227550 | A1 | 10/2006 | Huang | |
| 2012/0176789 | A1 | 7/2012 | Van Herpen et al. | |

* cited by examiner

LIGHTING DEVICE ARRANGED TO BE ATTACHED TO A MOUNTING SURFACE OF AN OBJECT

CROSS-REFERENCE TO PRIOR APPLICATIONS

This application is the U.S. National Phase application under 35 U.S.C. § 371 of International Application No. PCT/EP2021/055009, filed on Mar. 1, 2021, which claims the benefit of Europe Patent Application No. 20161351.0, filed on Mar. 6, 2020. These applications are hereby incorporated by reference herein.

FIELD OF THE INVENTION

The invention relates to a lighting device arranged to be attached to a mounting surface of an object, wherein the lighting device comprises an LED strip.

BACKGROUND OF THE INVENTION

An LED strip is a component with a plurality of light-emitting diodes arranged on a surface of an elongated carrier. The elongated carrier is typically a printed circuit board, which may be flexible, and the plurality of light-emitting diodes is typically arranged in the form of a linear array. The plurality of light-emitting diodes, and optionally also the carrier, may be encapsulated with a light-transmissive encapsulant.

Lighting devices comprising LED strips are widely available and commonly used for consumer as well as professional applications in indoor and outdoor lighting.

Depending on the application, the lighting device should have a desired light distribution or light output, which is usually different from one application to the other. A lighting device comprising an LED strip is typically arranged to provide a light distribution or light output that is designed to suit a specific application.

SUMMARY OF THE INVENTION

A lighting device comprising an LED strip that is arranged to be attached to a mounting surface of an object typically has an adhesive backing. The inventors have realized that a construction with an adhesive backing has a drawback. For certain applications of the lighting device the illumination output can only be obtained when the lighting device with an adhesive backing is mounted on the object in plain sight. When in such an application the lighting device with an adhesive backing would be attached to a different mounting surface of the object so that it is no longer in plain sight, the lighting device will not be able to provide the desired illumination output.

In view of the above, there is a need to have a lighting device comprising an LED strip that can be attached to a mounting surface of an object in an unobtrusive way without compromising the desired illumination output. It is an object of the invention to provide such an improved lighting device.

According to a first aspect of the invention, the lighting device comprises an LED strip, and the LED strip comprises (i) an elongated carrier with an upper surface having a first upper surface portion, (ii) a plurality of light-emitting diodes arranged on the first upper surface portion, and (iii) an attachment component for attaching the lighting device to the mounting surface of the object. The attachment component has an adhesive surface that faces in at least one of a first direction and a second direction, wherein the first direction is parallel to the normal of the upper surface of the elongated carrier, and wherein the second direction is perpendicular to the normal of the upper surface of the elongated carrier and perpendicular to the direction of elongation of the elongated carrier.

The LED strip has a LED strip length (L), a LED strip width (W) and a LED strip height (H).

The LED strip length (L) may be at least 10 times the LED strip width (W), such as at least 30 times the LED strip width (W), or at least 50 times the LED strip width (W).

The LED strip length (L) may be at least 10 times the LED strip height (H), such as at least 30 times the LED strip height (H), or at least 50 times the LED strip height (H).

The LED strip length (L) may be at least 1 meter, such as at least 1.5 meter, or at least 2 meters.

The upper surface of the elongated carrier may be light-reflective, for example with a reflectivity of at least 80%, such as at least 85%, or at least 90%.

The elongated carrier may have a thickness in the range of 0.2 millimeter to 3 millimeters, such as in the range of 0.4 millimeter to 2 millimeters, or in the range of 0.5 millimeter to 1 millimeter.

The elongated carrier may be rigid or flexible.

The elongated carrier may comprise a metal, such as aluminum or copper. Such an elongated carrier has good thermal management properties. Additionally, or alternatively, the elongated carrier may comprise a polymer, such as poly(methyl methacrylate) (PMMA), polycarbonate (PC), polyethylene (PE) or polyethylene terephthalate (PET).

The plurality of light-emitting diodes may consist of N light-emitting diodes, wherein N is at least 20, such as at least 40, at least 50, at least 80 or at least 100.

The plurality of light-emitting diodes may be arranged over the full length of the LED strip. They may additionally be equally distributed over the full length of the LED strip.

The plurality of light-emitting diodes may be arranged in a linear array of n×m light-emitting diodes, wherein n is 1.

Each light-emitting diode may be a phosphor-converted light-emitting diode or a direct-emitting light-emitting diode.

Each light-emitting diode may be arranged to emit white light or colored light. The emitted white light may have a correlated color temperature in the range of 2000 Kelvin to 6000 K, such as in the range of 2500 Kelvin to 5000 K, or in the range of 2700 Kelvin to 4000 K. The emitted white light may have a color rendering index of at least 80, such as at least 85, or at least 90.

The plurality of light-emitting diodes may have a first subset of light-emitting diodes and a second subset of light-emitting diodes, wherein each light-emitting diode of the first subset is arranged to emit light of a first correlated color temperature and each light-emitting diode of the second subset is arranged to emit light of a second correlated color temperature, the first correlated color being lower than the second correlated color temperature. The lighting device may comprise a controller for individually controlling the luminous flux of each of the first and second subsets of light-emitting diodes.

The plurality of light-emitting diodes may have a first subset of light-emitting diodes, a second subset of light-emitting diodes and a third subset of light-emitting diodes, wherein each light-emitting diode of the first subset is arranged to emit light of a first color, each light-emitting diode of the second subset is arranged to emit light of a second color and each light-emitting diode of the third subset is arranged to emit light of a third color, and wherein the first color, the second color and the third color are three different colors. For example, the first color is red, the second color is green, and the third color is blue. The lighting device may comprise a controller for individually controlling the luminous flux of each of the first, second and third subsets of light-emitting diodes.

The attachment component may have a linear shape.

The adhesive surface of the attachment component may be covered with a release liner.

The upper surface of the elongated carrier may have a second upper surface portion located next to the first upper surface portion in the direction of elongation of the elongated carrier, wherein the attachment component is provided on the second upper surface portion. The attachment component may cover at least 20% of the second upper surface portion, such at least 50% or at least 80%. The attachment component may also cover substantially all of the second upper surface portion.

The plurality of light-emitting diodes may be encapsulated with a light-transmissive encapsulant. The light-transmissive encapsulant may be a continuous encapsulant or it may have discrete encapsulant regions. The light-transmissive encapsulant may also encapsulate at least a part of the upper surface of the elongated carrier.

The light-transmissive encapsulant may comprise a polymer, such as a silicone. Such a light-transmissive encapsulant has good optical properties.

The attachment component may have a first attachment component part with a first adhesive surface portion facing the first direction, the first adhesive surface portion being located at a first height from the upper surface in the first direction, wherein the light-transmissive encapsulant has a side surface parallel to the first direction and facing the second upper surface portion, wherein the side surface has a side surface dimension in the first direction, and wherein the side surface dimension is larger than the first height. In this way, the light transmissive encapsulant extends above the first attachment component (as seen in the first direction) and the side surface of the encapsulant may be used for aligning the lighting device when attaching it to the mounting surface of the object.

The attachment component may have a second attachment component part provided on the side surface of the light-transmissive encapsulant, the second attachment component part having a second adhesive surface portion facing the second direction.

The light-transmissive encapsulant may be arranged to provide an optical effect chosen from the group consisting of refraction, diffraction, reflection, diffusion and conversion.

Refraction of light refers to the change in direction of a light ray passing from one medium to another or from a gradual change in the medium. Prisms and lenses may be used to redirect light by means of refraction.

Diffraction of light refers to various phenomena that occur when a light ray encounters an obstacle or a slit. It may be defined as the bending of light rays around the corners of an obstacle or through an aperture into the region of geometrical shadow of the obstacle or aperture, wherein the diffracting object or aperture effectively becomes a secondary source of the propagating light ray.

Reflection of lights refers to the change in direction of a light ray at an interface between two different media so that the light ray returns into the medium from which it originated. For specular reflection, the angle at which the light ray is incident on the surface equals the angle at which it is reflected. Specular reflection may be achieved by means of a mirror. For diffuse reflection, a light ray that is incident on a surface is scattered at many angles rather than at just one angle as in the case of specular reflection.

Diffusion of light refers to a situation wherein a light ray travels through a material without being absorbed, but rather undergoes repeated scattering events which change the direction of its path.

Conversion of light refers to a change in wavelength of a light ray, such as by means of photoluminescence, wherein light is emitted from any form of matter after absorption of electromagnetic radiation. Conversion of light by means of photoluminescence may be achieved by using a phosphor.

The elongated carrier may have an F-profile with a first profile part and a second profile part oriented parallel to each other and perpendicular to a third profile part, the first profile part and the second profile part being separated from each other by a non-zero separation distance, wherein the first upper surface portion is located between the first profile part and the second profile part.

The non-zero separation distance between the first and second profile parts may be substantially constant over the length of the LED strip.

The lighting device may further comprise a cover over the first upper surface portion, the cover closing the separation distance between the first profile part and the second profile part.

The cover may be arranged to provide an optical effect chosen from the group consisting of refraction, diffraction, reflection, diffusion and conversion.

The plurality of light-emitting diodes may be encapsulated with a light-transmissive encapsulant, wherein the light-transmissive encapsulant has a side surface parallel to the first direction, and wherein the attachment component is provided on the side surface such that the adhesive surface faces the second direction.

The lighting device may further comprise an electrical component, such as a sensor, a driver for providing power to the light-emitting diodes and/or a controller for controlling the light output of the light-emitting diodes.

The lighting device according to the invention may be attached to a mounting surface of an object, wherein the object may be part of a constructional element or a building material.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1:
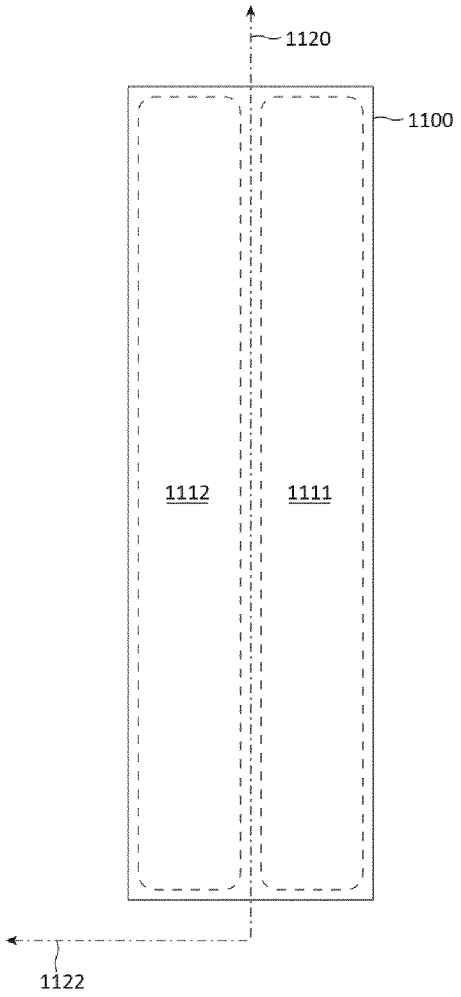
FIG. 1 shows a top view of an elongated carrier.

FIG. 1 shows a top view of an elongated carrier 1100 having an upper surface with a first upper surface portion 1111 and a second upper surface portion 1112. The first upper surface portion 1111 is located next to the second upper surface portion 1112 in the direction of elongation 1120 of the elongated carrier 1100. Also indicated in FIG. 1 is direction 1122, which is perpendicular to the normal of the upper surface and to the direction of elongation 1120 of the elongated carrier 1100.

Figure 2:
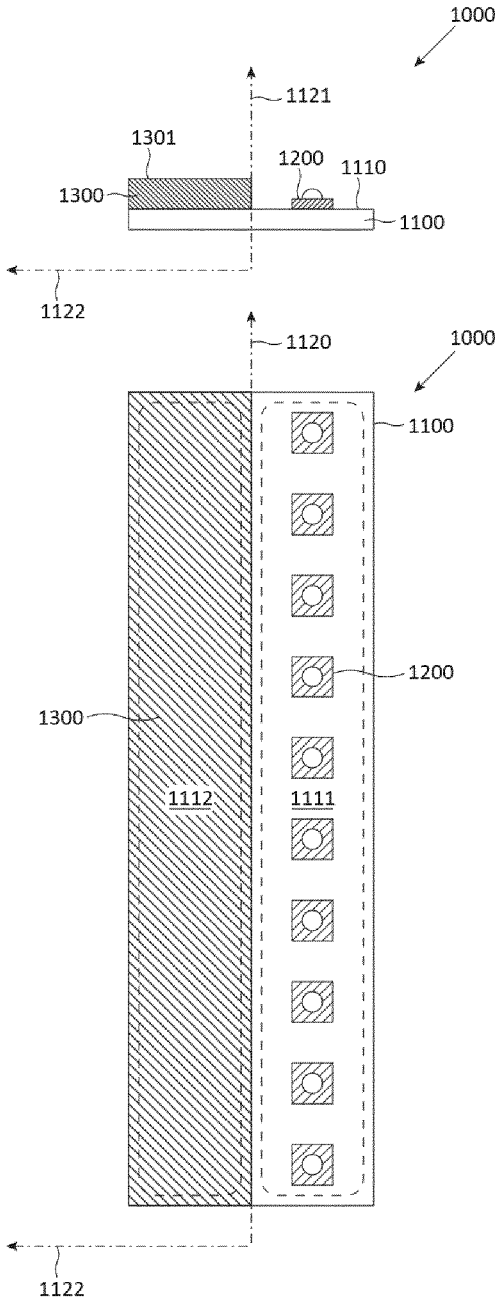
FIG. 2 shows a lighting device comprising the elongated carrier of FIG. 1.

FIG. 2 shows a lighting device 1000 that comprises the elongated carrier 1100 of FIG. 1. The lighting device 1000 is shown in a side view (upper portion of FIG. 2) and a top view (lower portion of FIG. 2).

The elongated carrier 1100 has an upper surface 1110 on which a plurality of light-emitting diodes 1200 is arranged. In particular, the light-emitting diodes 1200 are arranged on the first upper surface portion 1111 of the upper surface 1110.

Also arranged on the upper surface 1110 is an attachment component 1300. In particular, the attachment component 1300 is arranged on the second upper surface portion 1112 of the upper surface 1110.

The attachment component 1300 has an adhesive surface 1301 that faces in direction 1121. The direction 1121 is parallel to the normal of the upper surface 1110. The directions 1121 and 1122 will hereinafter be referred to as the first direction 1121 and the second direction 1122, respectively.

In the lighting device 1000 of FIG. 2, the light-emitting diodes 1200 are arranged in a linear array, and the attachment component 1300 has a linear shape. Alternatively, the arrangement of light-emitting diodes may have any configuration, and the attachment component may have any shape.

Figure 3:
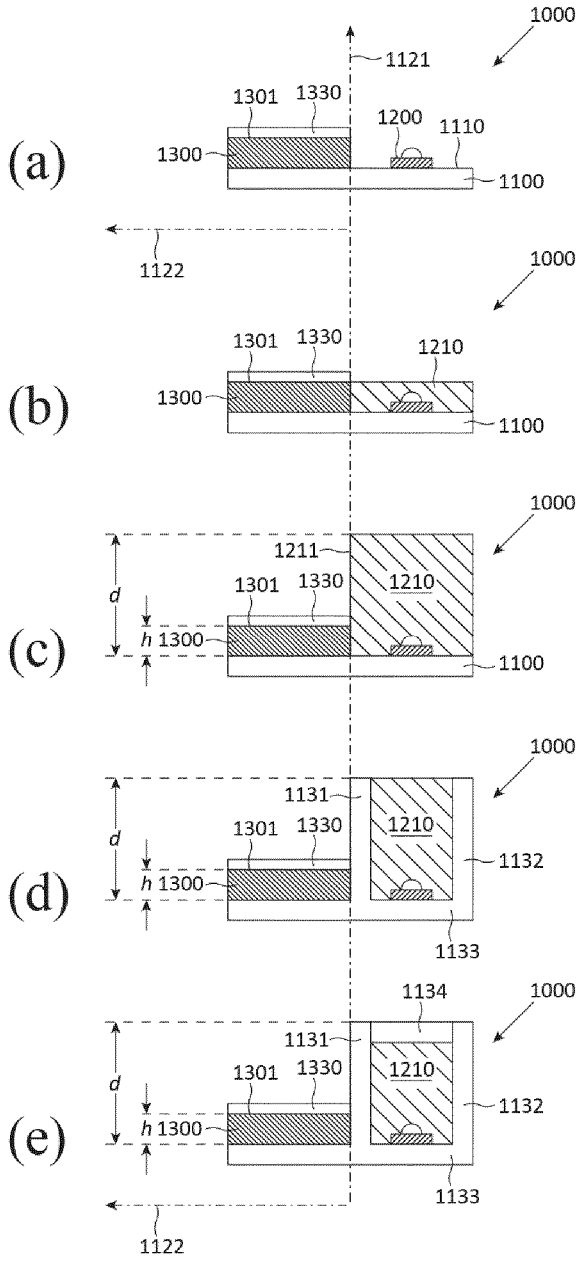
FIGS. 3(*a*) to 3(*e*) show several lighting devices in a cross-sectional view.

FIG. 3 shows several lighting devices 1000 in a cross-sectional view.

In the lighting devices 1000 shown in FIGS. 3(*a*) to 3(*e*), the adhesive surface 1301 is covered with a release liner 1330.

In the lighting devices 1000 shown in FIGS. 3(*b*) to 3(*e*), the light-emitting diodes 1200 are encapsulated with a light-transmissive encapsulant 1210. The light-transmissive encapsulant 1210 comprises a diffusive material. In other words, the light-transmissive encapsulant 1210 is arranged to provide the optical effect of diffraction. Other materials may alternatively be used for the light-transmissive encapsulant, such as a refractive material, a diffractive material, a reflective material or a converting material, so that the light-transmissive encapsulant is arranged to provide the optical effect of refraction, diffraction, reflection or conversion, respectively.

In the lighting device 1000 of FIG. 3(*b*), the light-transmissive encapsulant 1210 and the attachment component 1300 have substantially the same height.

In the lighting device 1000 of FIG. 3(*c*), the first adhesive surface portion 1311 is located at a first height h from the upper surface 1110 in the first direction 1121. The light-transmissive encapsulant 1210 has a side surface 1211 parallel to the first direction 1121 and facing the second upper surface portion 1112. The side surface 1211 has a side surface dimension d in the first direction 1121. The side surface dimension d is larger than the first height h. In other words, the light-transmissive encapsulant 1200 has a height that is more than that of the adhesive component 1300. This results in the light-transmissive encapsulant 1200 having a side surface 1211 that faces the adhesive component 1300.

In the lighting devices 1000 of FIGS. 3(*d*) and 3(*e*), the elongated carrier 1100 has an F-profile. The F-profile has a first profile part 1131, a second profile part 1132, and a third profile part 1133. The first profile part 1131 and the second profile part 1132 are oriented parallel to each other and perpendicular to the third profile part 1133. The first profile part 1131 and the second profile part 1132 are separated from each other by a non-zero separation distance.

In line with the terminology commonly used for structural beam profiles, each of the first profile part 1131 and the second profile part 1132 can be referred to as a flange, the third profile part 1133 can be referred to as a web, and the space enclosed by the first profile part 1131, the second profile part 1132, and the third profile part 1133 can be referred to as a channel.

The first upper surface portion 1111 is located between the first profile part 1131 and the second profile part 1132. In other words, in the lighting device 1000 of FIG. 3(*d*), the light-emitting diodes 1200 are arranged in the channel between the flanges of the F-profile.

In the lighting device 1000 of FIG. 3(*e*), a cover 1134 is provided over the first upper surface portion 1111. The cover 1134 closes the separation distance between the first profile part 1131 and the second profile part 1132. The cover 1134 is shown as a separate component, but it may alternatively be an integral part of the profile of the elongated carrier. In the latter case, the elongated carrier would essentially have a P-profile. In the context of the present invention, a P-profile is considered an F-profile with a closed channel.

Figure 4:
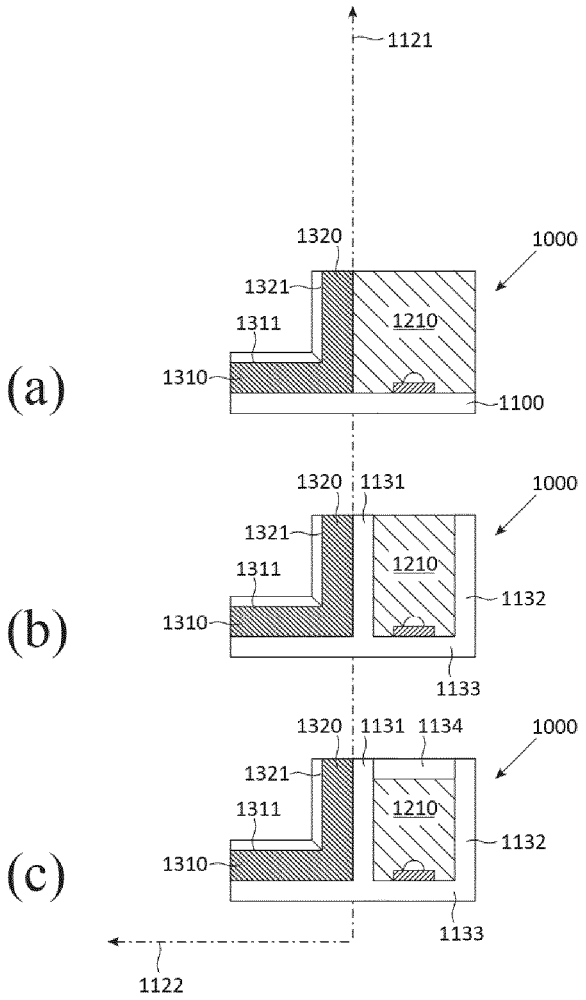
FIGS. 4(*a*) to 4(*c*) show several lighting devices in a cross-sectional view.

FIG. 4 shows several lighting devices 1000 in a cross-sectional view.

The lighting devices 1000 shown in FIGS. 4(*a*), 4(*b*) and 4(*c*) are similar to those shown in FIGS. 3(*c*), 3(*d*) and 3(*e*), respectively, but now the attachment component 1300 has a first attachment component part 1310 with a first adhesive surface portion 1311 facing the first direction 1121, and a second attachment component part 1320 with a second adhesive surface portion 1321 facing the second direction 1122.

In the lighting device 1000 of FIG. 4(*a*), the second attachment component part 1320 is provided on the side surface 1211 of the light-transmissive encapsulant 1210.

In the lighting devices 1000 of FIGS. 4(*b*) and 4(*c*), the second attachment component part 1320 is provided on the first profile part 1131 of the F-profile.

Figure 5:
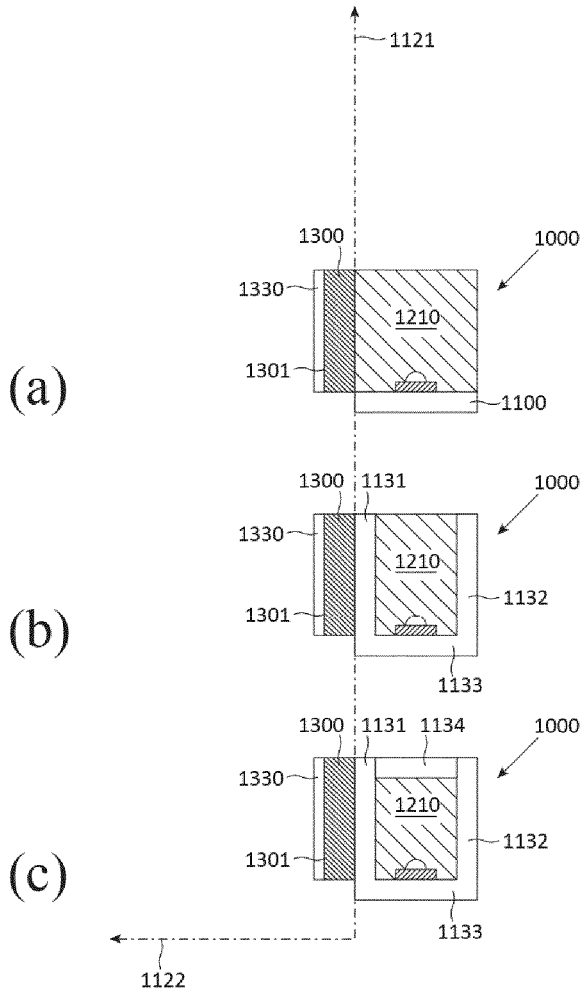
FIGS. 5(*a*) to 5(*c*) show several lighting devices in a cross-sectional view.

FIG. 5 shows several lighting devices 1000 in a cross-sectional view.

In the lighting devices 1000 shown in FIGS. 5(*a*) to 5(*c*), the elongated carrier 1100 has an upper surface 1110 on which a plurality of light-emitting diodes 1200 is arranged on a first upper surface portion 1111. The upper surface portion 1111 substantially coincides with the upper surface 1110.

In the lighting devices 1000 shown in FIGS. 5(*a*) to 5(*c*), the light-emitting diodes 1200 are encapsulated with a light-transmissive encapsulant 1210.

In the lighting device 1000 of FIG. 5(*a*), the attachment component 1300 is provided on a side surface of the light-transmissive encapsulant 1210. This side surface faces the second direction 1122.

In the lighting devices 1000 of FIGS. 5(*b*) and 5(*c*), the elongated carrier 1100 has a U-profile. The U-profile has a first profile part 1131, a second profile part 1132, and a third profile part 1133. The first profile part 1131 and the second profile part 1132 are oriented parallel to each other and perpendicular to the third profile part 1133. The first profile part 1131 and the second profile part 1132 are separated from each other by a non-zero separation distance. The first upper surface portion 1111 is located between the first profile part 1131 and the second profile part 1132.

In the lighting devices 1000 of FIGS. 5(*b*) and 5(*c*), the attachment component 1300 is provided on the first profile part 1131 of the U-profile.

In the lighting device 1000 of FIG. 5(*c*), a cover 1134 is provided over the first upper surface portion 1111. The cover 1134 closes the separation distance between the first profile part 1131 and the second profile part 1132. The cover 1134 is shown as a separate component, but it may alternatively be an integral part of the profile of the elongated carrier. In the latter case, the elongated carrier would essentially be a rectangular tubing.

Figure 6:
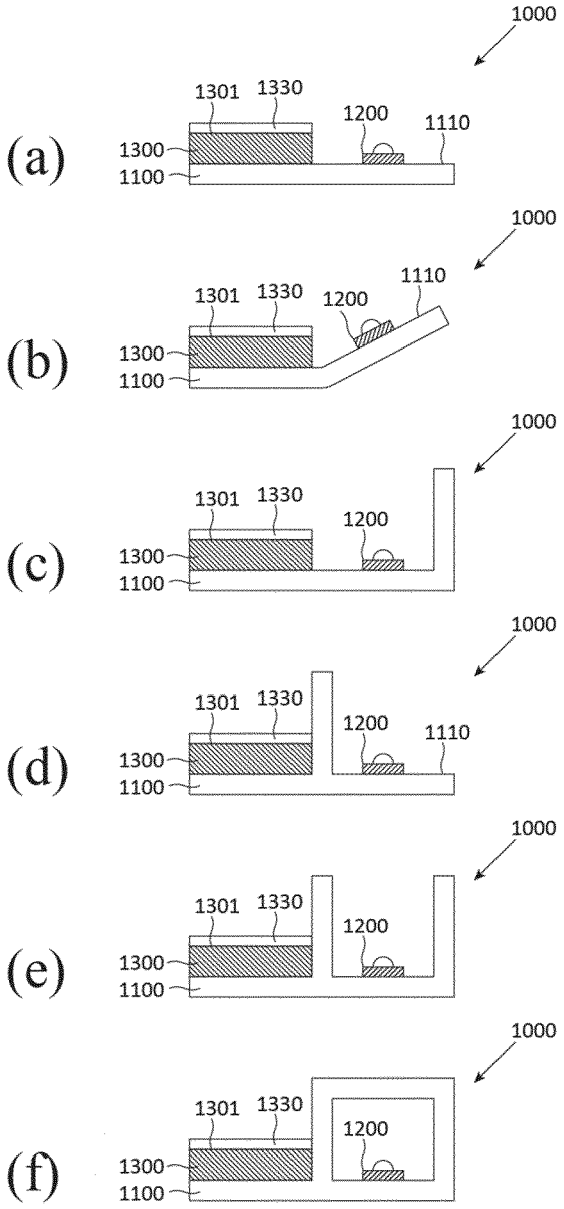
FIGS. 6(*a*) to 6(*f*) show several lighting devices in a cross-sectional view.

FIG. 6 shows several lighting devices 1000 in a cross-sectional view.

In the lighting devices 1000 of FIGS. 6(*a*) to 6(*f*), the elongated carrier 1100 has an upper surface 1110. The light-emitting diodes 1200 are arranged on a first upper surface portion 1111 of the upper surface 1110, and the attachment component 1300 is arranged on a second upper surface portion 1112 of the upper surface 1110, wherein the first upper surface portion 1111 is located next to the second upper surface portion 1112 in the direction of elongation 1120 of the elongated carrier 1100. It is noted that, for the sake of clarity, the reference numerals 1111, 1112 and 1120 are not included in FIG. 6. The features that these reference numerals refer to are analogous to the features with the same reference numerals as shown in the other figures.

The lighting device 1000 shown in FIG. 6(*a*) is similar to the lighting device 1000 shown in FIG. 3(*a*). From the perspective of manufacturability, the lighting device 1000 of FIG. 6(*a*) will be easiest to manufacture. It also has a layout that easily allows the elongated carrier 1100 to be flexible.

The lighting device 1000 shown in FIG. 6(*b*) has a configuration wherein the normal of the first surface part 1111 is not parallel to the normal of the second surface part 1112. In other words, it has a configuration wherein the first surface part 1111 is inclined with respect to the second surface part 1112. In the lighting device 1000 shown in FIG. 6(*b*), the elongated carrier 1100 is rigid. Alternatively, the elongated carrier may be such that it can be deformed from a planar configuration into the configuration shown in FIG. 6(*b*).

In the lighting devices 1000 shown in FIGS. 6(*c*), 6(*d*), 6(*e*) and 6(*f*), the elongated carrier 1100 has an L-profile, a T-profile, an F-profile and a P-profile, respectively. Such profiles result in an increased mechanical rigidity, with the P-profile providing the highest mechanical rigidity The lighting devices 1000 of FIGS. 6(*c*) to 6(*f*) all have a profile part that is oriented perpendicular to the first surface part 1111 on which the light-emitting diodes 1200 are arranged. These profile parts may be arranged to provide an optical effect chosen from the group consisting of refraction, diffraction, reflection, diffusion and conversion. The more profile parts, the more freedom to provide a variety of optical effects.

Figure 7:
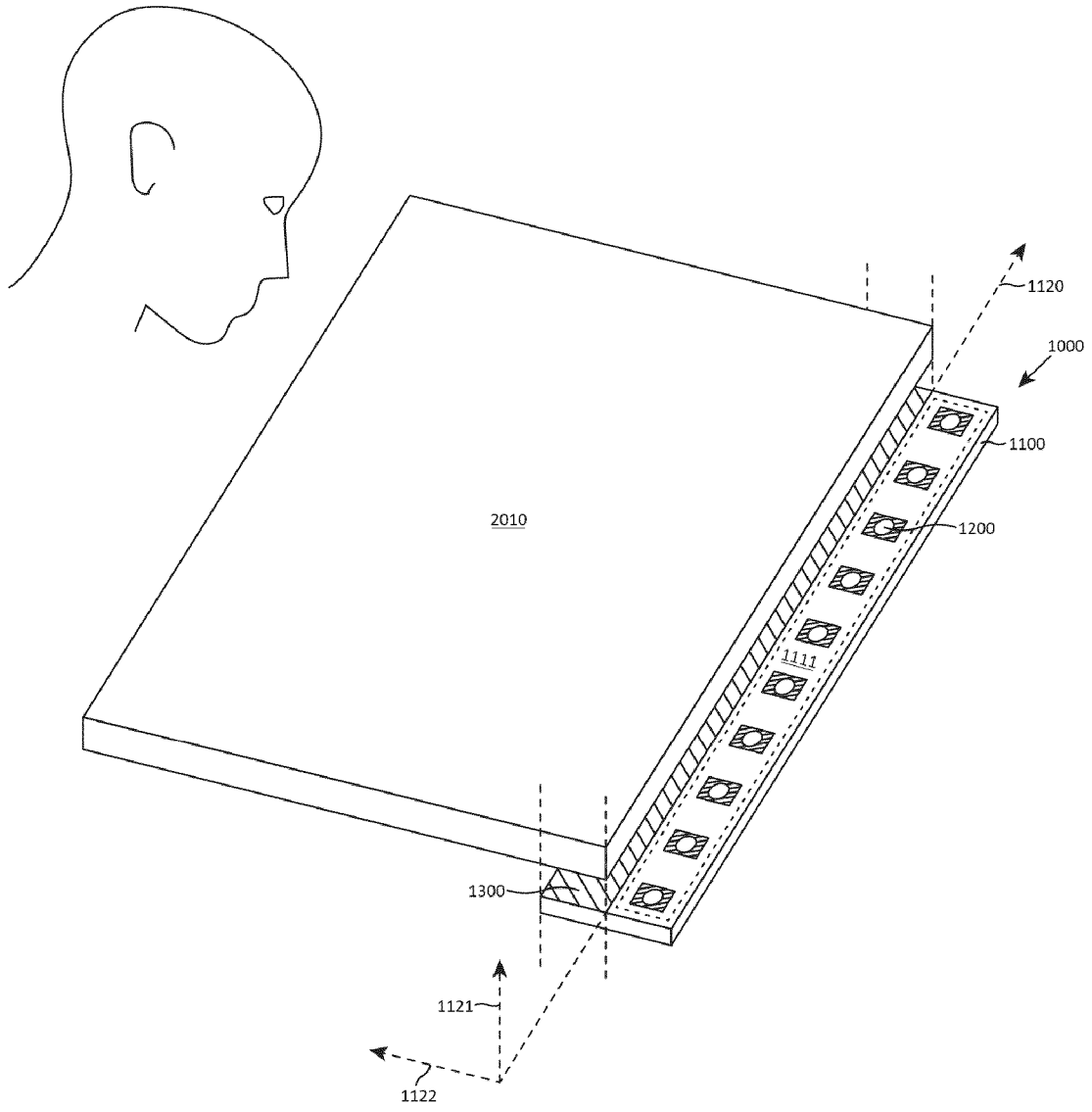
FIG. 7 shows a perspective view of a panel.

FIG. 7 shows a perspective view of a panel 2010, that may be used as a tabletop or a shelf. In the context of the present invention, tabletops and shelves and any other applications of a panel are considered examples of constructional elements.

The panel 2010 has an upper surface and a lower surface. In the configuration shown FIG. 7, the lower surface of the panel 2010 represents a mounting surface for the lighting device 1000, which is similar to the lighting devices 1000 shown in FIGS. 2 and 3(*a*). The lighting device 1000 can be attached to the lower surface of the panel 2010 via the attachment component 1300. For an observer that looks at the panel 2010 from a side that is opposite to the side where the lighting device 1000 is attached, the lighting device 1000 is not in plain sight, but it is still capable of providing the same illumination output as a lighting device with an adhesive backing that would be attached to the upper surface of the panel 2010.

In an alternative configuration, the upper surface of the panel 2010 represents a mounting surface to which the lighting device 1000 may be attached via the attachment component 1300.

Figure 8:
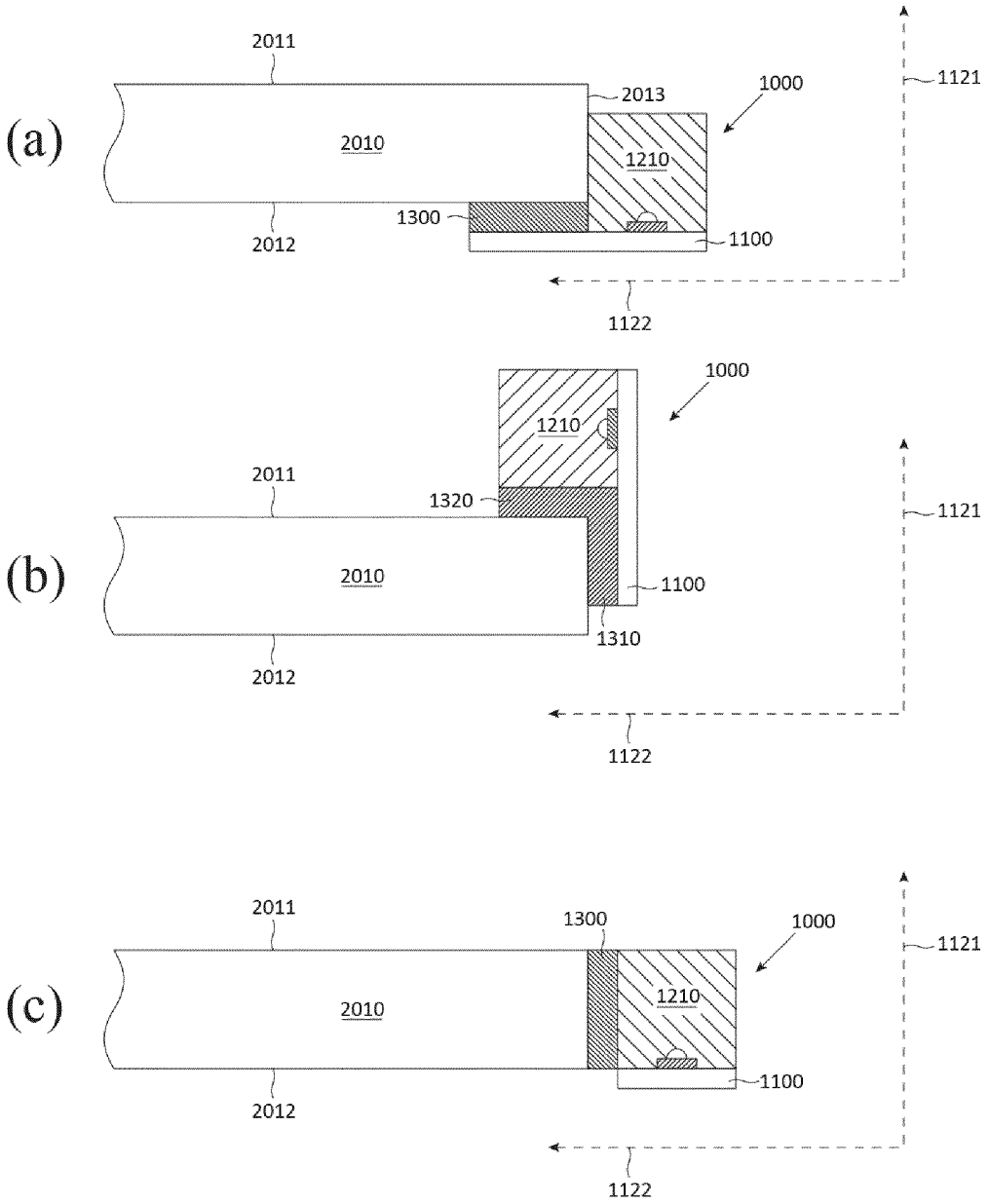
FIGS. 8(*a*) to 8(*c*) show a side view of the panel of FIG. 7.

Each of FIGS. 8(*a*) to 8(*c*) shows a side view of the panel 2010 also shown in FIG. 7. The upper and lower surfaces of the panel 2010 are now indicated with reference numerals 2011 and 2012, respectively. The panel 2010 also has an edge surface 2013, which for the sake of clarity is only indicated in FIG. 8(*a*).

In the configuration shown in FIG. 8(*a*), lighting device 1000, which is similar to the lighting device 1000 shown in FIG. 3(*c*), is attached to the lower surface 2012 of the panel 2010 via the attachment component 1300. The side surface of the encapsulant 1210 is used to align the lighting device 1000 to the edge surface 2013 of the panel 2010.

In the configuration shown in FIG. 8(*b*), lighting device 1000, which is similar to the lighting device 1000 shown in FIG. 4(*a*), is attached to the edge surface 2013 of the panel 2010 via the first attachment component part 1310, and to the upper surface 2011 via the second attachment component part 1320.

In the configuration shown in FIG. 8(*c*), lighting device 1000, which is similar to the lighting device 1000 shown in FIG. 5(*a*), is attached to the edge surface 2013 of the panel 2010 via the attachment component 1300.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements.

The mere fact that certain features are recited in mutually different dependent claims does not indicate that a combination of these features cannot be used to advantage. The various aspects discussed above can be combined in order to provide additional advantages. Further, the person skilled in the art will understand that two or more embodiments may be combined.

The invention claimed is:

1. A lighting device arranged to be attached to a mounting surface of an object, the lighting device comprising an LED strip, the LED strip comprising:

an elongated carrier with an upper surface having a first upper surface portion and a second upper surface portion located next to the first upper surface portion in the direction of elongation of the elongated carrier, a plurality of light-emitting diodes arranged on the first upper surface portion, the plurality of light-emitting diodes being encapsulated with a light-transmissive encapsulant, the light-transmissive encapsulant being arranged to provide an optical effect chosen from the group consisting of refraction, diffraction, reflection, diffusion and conversion, and an attachment component for attaching the lighting device to the mounting surface, wherein the attachment component is provided on the second upper surface portion, wherein the attachment component comprises an adhesive surface that faces in at least one of a first direction and a second direction, the first direction being parallel to the normal of the upper surface, and the second direction being perpendicular to the normal of the upper surface and to the direction of elongation of the elongated carrier, wherein the attachment component has a first attachment component part with a first adhesive surface portion facing the first direction, the first adhesive surface portion being located at a first height (h) from the upper surface in the first direction, and wherein the light-transmissive encapsulant has a side surface parallel to the first direction and facing the second upper surface portion, the side surface having a side surface dimension (d) in the first direction, and wherein the side surface dimension (d) is larger than the first height (h).

2. The lighting device as claimed in claim 1, wherein the attachment component has a second attachment component part provided on the side surface of the light-transmissive encapsulant, the second attachment component part having a second adhesive surface portion facing the second direction.

3. The lighting device as claimed in claim 1, wherein the elongated carrier has an F-profile with first profile part and a second profile part oriented parallel to each other and perpendicular to a third profile part, the first profile part and the second profile part being separated from each other by a non-zero separation distance, and wherein the first upper surface portion is located between the first profile part and the second profile part.

4. The lighting device as claimed in claim 3, further comprising a cover over the first upper surface portion, the cover closing the separation distance between the first profile part and the second profile part.

5. The lighting device as claimed in claim 1, wherein the elongated carrier is flexible.

6. The lighting device as claimed in claim 1, wherein the plurality of light-emitting diodes are arranged in a linear array, and wherein the attachment component has a linear shape.

7. The lighting device as claimed claim 1, wherein the adhesive surface is covered with a release liner.

8. A constructional element comprising:

a mounting surface, and the lighting device as claimed in claim 1, wherein the lighting device is attached to the mounting surface via the attachment component.

* * * * *